US005180483A

United States Patent [19]

Braams et al.

[11] Patent Number: 5,180,483

[45] Date of Patent: Jan. 19, 1993

[54] DEWAXING PROCESS

[75] Inventors: Johannes F. H. Braams; Marinus J. Reynhout, both of Amsterdam, Netherlands

[73] Assignee: Shell Oil Company, Houston, Tex.

[21] Appl. No.: 766,254

[22] Filed: Sep. 27, 1991

[30] Foreign Application Priority Data

Oct. 23, 1990 [NL] Netherlands ..... 9002305

[51] Int. Cl.[5] ..... C10G 73/02; C10G 73/06

[52] U.S. Cl. ..... 208/28; 208/31; 208/33; 208/38

[58] Field of Search ..... 208/28, 31, 33, 38

[56] References Cited

U.S. PATENT DOCUMENTS

| | | | |
|---|---|---|---|
| 3,355,379 | 11/1967 | Leonard | 208/31 |
| 3,620,696 | 11/1971 | Hollyday et al. | 585/10 |
| 3,806,442 | 4/1974 | Reig et al. | 208/33 |
| 3,957,659 | 5/1976 | van de Kraats et al. | 252/8.3 |
| 4,159,069 | 4/1979 | Rossi | 208/33 |
| 4,191,631 | 3/1980 | Grisham | 208/33 |
| 4,192,733 | 3/1980 | Onodera et al. | 208/33 |
| 4,451,353 | 5/1984 | Briens et al. | 208/33 |
| 4,728,414 | 3/1988 | West et al. | 208/33 |

FOREIGN PATENT DOCUMENTS

| | | |
|---|---|---|
| 0160754 | 11/1985 | European Pat. Off. . |
| 0235865 | 9/1987 | European Pat. Off. . |
| 0322018 | 6/1989 | European Pat. Off. . |
| 0376364 | 7/1990 | European Pat. Off. . |
| 1272614 | 5/1972 | United Kingdom . |

*Primary Examiner*—Theodore Morris
*Assistant Examiner*—P. L. Hailey
*Attorney, Agent, or Firm*—James O. Okorafor

[57] ABSTRACT

This invention relates to a process of dewaxing a hydrocarbon oil involving the steps of separating and precipitating the wax component of the hydrocarbon oil. This process is facilitated by incorporating into the oil a linear polymer of carbon monoxide with one or more olefins comprising α-olefins with at least 10 carbon atoms per molecule ($C_{10+}$ α-olefins) wherein in this polymer monomer units of carbon monoxide and olefins are present in a substantially alternating arrangement. Optionally, the process may also involve the use of a polymer of one or more olefinically unsaturated compound comprising of alkyl acrylates or alkyl methacrylates with at least 8 carbon atoms in the alkyl group ($C_{8+}$ alkyl esters). The process may be practiced using the single-stage or multi-stage dilution method.

20 Claims, No Drawings

DEWAXING PROCESS

BACKGROUND OF THE INVENTION

The invention relates to a process for dewaxing a wax-containing hydrocarbon oil.

Dewaxing is an important process which is applied in the refining of hydrocarbon oils, since the removal of the wax leads to an oil with a considerably improved pour point. The process is usually carried out by cooling the oil to a temperature that is low enough to cause the wax to precipitate and then removing the wax from the oil by filtration. Usually, solvents are added to the oil which can dissolve the oil and precipitate the wax. The precipitated wax has a tendency to block the filter during the filtration. As a consequence, the filtration rate is substantially reduced and the quantity of oil remaining behind in the filter cake increases considerably. These difficulties can be avoided by carrying out the dewaxing in the presence of certain polymers, which are referred to as dewaxing aids. An example of a class of polymers suitable for this purpose is formed by polymers from one or more olefinically unsaturated compounds which consist at least partly of alkylacrylates or alkylmethacrylates with at least 8 carbon atoms in the alkyl group (referred to hereinafter as $C_{8+}$ alkyl esters).

In an investigation by the applicant into the use of polymers as dewaxing aids, a class of polymers was found, which polymers were found to be extremely well suited for this purpose. On comparing the behavior of these polymers with that of the $C_{8+}$ alkyl ester polymers, it can be seen that in a number of cases the previously mentioned polymers have a higher activity. This means that in comparison with the $C_{8+}$ alkyl ester polymers, in a number of cases the polymers investigated by the applicant for this purpose give, at an equal concentration, a greater increase in the filtration rate and/or a greater reduction in the quantity of oil remaining behind in the filter cake, or that a given increase in the filtration rate and/or reduction in the quantity of oil remaining behind in the filter cake can be obtained at a lower concentration. The polymers having improved dewaxing capabilities are linear polymers of carbon monoxide with one or more olefins which consist at least partly of $\alpha$-olefins with at least 10 carbon atoms per molecule (hereinafter referred to as $C_{10+}$ $\alpha$-olefins), wherein in these polymers monomer units of carbon monoxide and olefins are present in a substantially alternating arrangement.

In the investigation by the applicant into the use of polymers as dewaxing aids, it was further found that mixtures of polymers selected from each of the two above-mentioned classes are also very suitable for use as dewaxing aids.

SUMMARY OF THE INVENTION

The present invention relates to a dewaxing process in which a wax-containing hydrocarbon oil is dewaxed by precipitation of the wax and separation of the wax from the oil and in which the precipitation of the wax is carried out in the presence of (a) linear polymers of carbon monoxide with one or more olefins which comprises of $C_{10+}$ $\alpha$-olefins, wherein in these polymers, monomer units of carbon monoxide and olefins are present in a substantially alternating arrangement.

Optionally the linear polymers may be used with (b) polymers from one or more olefinically unsaturated compounds which comprises of $C_{8+}$ alkyl esters.

The invention further relates to the hydrocarbon oils thus dewaxed and to the wax thus obtained.

The process of the invention can in principle be applied to dewaxing any wax-containing hydrocarbon oil. The process is preferably applied to dewaxing waxy raffinates obtained from lubricating oil fractions by applying aromatic extraction to them.

DETAILED DESCRIPTION OF THE INVENTION

As pointed out above, the dewaxing can very suitably be carried out by cooling the oil in the presence of a dewaxing solvent. Examples of solvents which can be used for this purpose are low molecular weight hydrocarbons such as ethane, propane, butane and isobutane, polar solvents such as acetone, methyl ethyl ketone, propanol, butanol and pentanol, diethyl ether, diisopropyl ether, ethylene dichloride and ethylene trichloride, as well as mixtures of the aforementioned polar solvents with an aromatic solvent such as benzene or toluene. As a dewaxing solvent, a mixture of methyl ethyl ketone and toluene is preferred, in particular such a mixture in which both components are present in approximately equal quantities. When using a dewaxing solvent, preferably just enough of it is used for the oil to remain in solution at the dewaxing temperature while as little wax as possible dissolves. The solvent/oil ratio to be used depends, amongst other things, on the wax content of the oil, the viscosity of the oil, the temperature and other conditions applied during the dewaxing. There is preference for 1 to 10 volumes, and in particular 2 to 4 volumes of solvent per volume of wax-containing oil.

The dewaxing in the presence of a solvent can be carried out under application of single-stage or multi-stage dilution. If the dewaxing is carried out using single-stage dilution, the dewaxing takes place in a single step by gradually cooling to the dewaxing temperature a mixture of the oil to be dewaxed and the total quantity of solvent intended for the dewaxing, which mixture is at an elevated temperature. If the dewaxing is carried out using multi-stage dilution, the dewaxing takes place in two or more steps by gradually cooling to a temperature above the dewaxing temperature a mixture of the oil to be dewaxed and a part of the total quantity of solvent intended for the dewaxing, which mixture is at an elevated temperature, and then again adding a part of the total quantity of solvent intended for the dewaxing and again cooling and, if desired, repeating these steps one or more times until all the solvent has been added and the dewaxing temperature has been reached. The dewaxing in the presence of a solvent is preferably carried out using a solvent/oil mixture at a temperature of 45°–90° C. Suitable dewaxing temperatures lie between −10° and −45° C.

The molecular weight of the polymers which are eligible to be used as dewaxing aids in the process of the invention can vary within wide limits. Preferably, polymers are used with an average molecular weight, calculated as weight average ($\overline{M}_w$), of between $10^3$ and $10^6$ and in particular between $10^4$ and $10^6$. Both the $C_{10+}$ $\alpha$-olefins which are used as monomers in the preparation of the polymers mentioned under a) and the alkyl groups present in the $C_{8+}$ alkyl esters which are used in the preparation of the polymers mentioned under b) are preferably unbranched. Both the $C_{10+}$ $\alpha$-olefins and the alkyl groups present in the $C_{8+}$ alkyl esters preferably contain fewer than 40 and in particular fewer than 30 carbon atoms. The preference for a particular molecular weight of the polymers and for a particular number of carbon atoms in the $C_{10+}$ α-olefins and in the alkyl groups of the $C_{8+}$ alkyl esters used as monomers in the preparation of the polymers is mainly determined by the nature of the waxes present in the hydrocarbon oil.

In the preparation of the polymers mentioned under a), in addition to $C_{10+}$ α-olefins it is also possible to use olefins with fewer than 10 carbon atoms, such as ethene, propene, butene-1 and cyclopentene. Preferably only $C_{10+}$ α-olefins are used as olefins in the preparation of the polymers mentioned under a). The monomer mixture from which the polymers mentioned under a) are prepared can in addition to carbon monoxide contain either one or more $C_{10+}$ α-olefins. An example that can be given of a copolymer with which, according to the invention, favourable results were obtained is a carbon monoxide/n-octadecene-1 copolymer. Polymers of carbon monoxide with a mixture of unbranched α-olefins with 12–18 or 20–24 carbon atoms per molecule were also found to be very suitable for the present purpose.

As pointed out above, as regards the polymers mentioned under a) there is preference for polymers on the basis of carbon monoxide with one or more $C_{10+}$ α-olefins, which polymers have an $\overline{M}_w$ of more than $10^4$. In a recent investigation by the applicant into these polymers, an attractive method of preparation was found. This method consists essentially of contacting the monomers at elevated temperature and pressure and in the presence of a diluent consisting for more than 90% v of an aprotic liquid with a catalyst composition containing a Group VIII metal and a phosphorus bidentate ligand with the general formula $(R_1R_2P)_2R$ where $R_1$ and $R_2$ represent identical or different optionally polar substituted aliphatic hydrocarbon groups and R is a divalent organic bridge group which contains at least two carbon atoms in the bridge connecting the two phosphorus atoms with each other. There is preference for the use of catalyst compositions which per g.atom Group VIII metal contain 0.75–1.5 mol of a phosphorus bidentate ligand in which the groups $R_1$ and $R_2$ are identical alkyl groups with not more than 6 carbon atoms and which, moreover, per g.atom Group VIII metal contain 2–50 mol of an anion of an acid with a pKa of less than 2 and if desired 10–1000 mol of an organic oxidizing agent. There is particular preference for catalyst compositions based on palladium acetate, 1,3-bis(di-n-butylphosphino)propane, 1,4-naphthoquinone and trifluoroacetic acid or nickel perchlorate. The preparation of the polymers is preferably carried out at a temperature of 30°–130° C., a pressure of 5–100 bar and a molar ratio of the olefins to carbon monoxide of 5:1 to 1:5 and using a quantity of catalyst composition which per mol of olefin to be polymerized contains $10^{-6}$ to $10^{-3}$ g.atom Group VIII metal. The polymerization is preferably carried out in a diluent that contains a small quantity of a protic liquid. A very suitable diluent for the present polymerization is a mixture of tetrahydrofuran and methanol.

In the preparation of the polymers mentioned under b), in addition to $C_{8+}$ alkyl esters, it is also possible to use other olefinically unsaturated compounds, such as alkyl acrylates and alkyl methacrylates with fewer than 8 carbon atoms in the alkyl group, olefinically unsaturated aromatic compounds such as styrene and olefinically unsaturated heterocyclic compounds such as vinyl pyridines. The monomer mixture from which the polymers mentioned under b) are prepared can contain either one or more $C_{8+}$ alkyl esters. An example which can be given of a terpolymer with which favourable results were obtained according to the invention is an n-octadecylacrylate/n-eicosylacrylate/n-docosylacrylate terpolymer. An example of a tetrapolymer suitable for the present purpose is a methylacrylate/n-octadecylacrylate/n-eicosylacrylate/n-docosylacrylate tetrapolymer.

In the dewaxing according to the invention, either one or more polymers mentioned under a) can be used, if desired in combination with one or more polymers mentioned under b). The quantity of polymer which according to the invention is incorporated in the hydrocarbon oil to be dewaxed preferably amounts to 1–10,000 and in particular 10–1000 mg per kg hydrocarbon oil. If in the dewaxing according to the invention use is made of a polymer mixture in which both the polymers mentioned under a) and the polymers mentioned under b) are present, there is preference for mixtures containing 1–90 wt %, and more particularly 10–75 wt % of the polymers mentioned under a).

The following examples further detail the various aspects of this invention.

EXAMPLE 1

A carbon monoxide/n-octadecene-1 copolymer was prepared as follows. Into a stirred autoclave with a capacity of 250 ml which contained a 100 ml tetrahydrofuran and 40 g n-octadecene-1 in a nitrogen atmosphere a catalyst solution was introduced containing:

5 ml methanol,
0.1 mmol palladium acetate,
0.5 mmol nickel perchlorate,
0.12 mmol 1,3-bis(di-n-butylphosphino)propane, and
6 mmol 1,4-naphthoquinone.

After forcing in carbon monoxide to a pressure of 40 bar, the contents of the autoclave were brought to 50° C. After 30 hours the polymerization was terminated by cooling the reaction mixture to room temperature and releasing the pressure. After adding acetone to the reaction mixture, the polymer was filtered off, washed with acetone and dried. 40 g copolymer was obtained with an $\overline{M}_w$ of 20,300.

EXAMPLE 2

A polymer of carbon monoxide with a mixture of linear α-olefins with 20–24 carbon atoms per molecule was prepared in substantially the same way as the carbon monoxide/n-octadecene-1 copolymer in Example 1, but with the following differences:

a) the autoclave contained 40 g of a mixture of linear α-olefins with 20–24 carbon atoms per molecule instead of n-octadecene-1,
b) carbon monoxide was forced into the autoclave to a pressure of 70 bar instead of 40 bar, and
c) the reaction time was 15 hours instead of 30 hours.

38 g polymer was obtained with an $\overline{M}_w$ of 22,700.

EXAMPLE 3

A polymer of carbon monoxide with a mixture of linear α-olefins with 12–18 carbon atoms per molecule was prepared in substantially the same was as the carbon monoxide/n-octadecene-1 copolymer in Example 1, but with the following differences:

a) the autoclave contained 40 g of a mixture of linear α-olefins with 12–18 carbon atoms per molecule instead of n-octadecene-1,
b) the reaction time was 15 hours instead of 30 hours. 30 g polymer was obtained with an $\overline{M}_w$ of 23,000.

EXAMPLE 4

The following polymers were tested as dewaxing aids in the dewaxing of two distillate lubricating oils (A and B). Oil A was a waxy raffinate with a viscosity index of 130 and oil B was a waxy raffinate with a viscosity index of 160.

Additive 1: The copolymer prepared according to Example 1.
Additive 2: The polymer prepared according to Example 2.
Additive 3: The polymer prepared according to Example 3.
Additive 4: A methyl acrylate/n-octadecyl acrylate/n-eicosyl acrylate/n-docosyl acrylate tetrapolymer with an $\overline{M}_w$ of 660,000.
Additive 5: An n-octadecyl acrylate/n-eicosyl acrylate/n-docosyl acrylate terpolymer with an $\overline{M}_w$ of 500,000.

The polymers were introduced into the oils in the form of a solution of 50 wt % solids in toluene. The results of the experiments are shown in Table 1. The additives are expressed in mg polymer solution per kg wax-containing oil.

Experiment 1

In this experiment oil A was dewaxed using single-stage dilution. This consisted of adding to a sample of oil A heated to 60° C. a mixture, also at 60° C., of equal parts by volume of methyl ethyl ketone and toluene, 3 parts by weight of the mixture being added per part by weight of oil. The mixture thus obtained was cooled at a rate of 3° C. per minute to −20° C. and filtered at this temperature.

Experiment 2

This experiment was carried out in substantially the same way as Experiment 1, but with the difference that, before adding the solvent, 600 mg/kg of a polymer solution containing Additive 4 was incorporated in the warm oil.

Experiment 3

This experiment was carried out in substantially the same way as Experiment 1, but with the difference that, before adding the solvent, 600 mg/kg of a polymer solution containing Additive 1 was incorporated in the warm oil.

Experiment 4

This experiment was carried out in substantially the same way as Experiment 1, but with the difference that the mixture was cooled to −5° C. instead of to −20° C. and the filtration was also carried out at −5° C.

Experiment 5

This experiment was carried out in substantially the same way as Experiment 1, but with the following differences:

a) prior to the addition of the solvent, 200 mg/kg of a polymer solution containing additive 5 was incorporated in the warm oil, and
b) the mixture was cooled to −5° C. instead of to −20° C. and the filtration was also carried out at −5° C.

Experiment 6

This experiment was carried out in substantially the same way as Experiment 1, but with the following differences:

a) prior to the addition of the solvent, 200 mg/kg of a polymer solution containing additives 1 and 5 in a weight ratio of 1:4 was incorporated in the warm oil, and
b) the mixture was cooled to −5° C. instead of to −20° C. and the filtration was also carried out at −5° C.

Experiment 7

This experiment was carried out in substantially the same way as Experiment 1, but with the difference that the dewaxing was applied to oil B instead of to oil A.

Experiment 8

This experiment was carried out in substantially the same way as Experiment 1, but with the following differences:

a) the dewaxing was applied to oil B instead of to oil A, and
b) prior to the addition of the solvent, 400 mg/kg of a polymer solution containing additive 2 was incorporated in the warm oil.

Experiment 9

This experiment was carried out in substantially the same way as Experiment 1, but with the following differences:

a) the dewaxing was applied to oil B instead of to oil A, and
b) prior to the addition of the solvent, 400 mg/kg of a polymer solution containing additives 2 and 5 in a weight ratio of 1:9 was incorporated in the warm oil.

Experiment 10

This experiment was carried out in substantially the same way as Experiment 1, but with the following differences:

a) the dewaxing was applied to oil B instead of to oil A, and
b) prior to the addition of the solvent, 400 mg/kg of a polymer solution containing additives 3 and 5 in a weight ratio of 1:9 was incorporated in the warm oil.

Experiment 11

In this experiment oil A was dewaxed using multi-stage dilution. This consisted of adding to a sample of oil A heated to 65° C. a first portion of a mixture, also at 65° C., of 55 parts by volume of methyl ethyl ketone and 45 parts by volume of toluene, 1 part by weight of solvent being added per 5 parts by weight of oil. The mixture thus obtained was cooled at a rate of 4° C. per minute to 40° C. Subsequently, a second portion of the solvent, also brought to 40° C., was added to the mixture in a quantity of 1 part by weight of solvent per 5 parts by weight of oil. The mixture thus obtained was cooled at a rate of 4° C. per minute to −5° C. Subsequently, a third portion of the solvent, also cooled to −5° C., was added to the mixture in a quantity of 1 part by weight of solvent per 5 parts by weight of oil. The mixture thus obtained was cooled at a rate of 4° C. per minute to −15° C. Subsequently, a fourth portion of the solvent, also cooled to −15° C., was added to the mixture in a quantity of 1 part by weight of solvent per 1 part by weight of oil. Finally, the mixture thus obtained was cooled at a rate of 4° C. per minute to −17° C. and filtered at this temperature.

Experiment 12

This experiment was carried out in substantially the same way as Experiment 11, but with the difference that, before the first addition of the solvent, 200 mg/kg of a polymer solution containing additive 5 was incorporated in the warm oil.

Experiment 13

This experiment was carried out in substantially the same way as Experiment 11, but with the difference that, before the first addition of the solvent, 200 mg/kg of a polymer solution containing additives 1 and 5 in a weight ratio of 1:4 was incorporated in the warm oil.

TABLE I

Results of the dewaxing experiments

| Experiment No. | Oil | Filtration temperature °C. | Additive No. g/(sec · m²) | Filtration rate % w | Oil in filter-cake |
|---|---|---|---|---|---|
| 1 | A | −20 | — | 86 | 64 |
| 2 | A | −20 | 4 | 90 | 61 |
| 3 | A | −20 | 1 | 106 | 60 |
| 4 | A | −5 | — | 175 | 60 |
| 5 | A | −5 | 5 | 169 | 54 |
| 6 | A | −5 | 1 + 5 | 196 | 54 |
| 7 | B | −20 | — | 227 | 79 |
| 9 | B | −20 | 2 | 234 | 76 |
| 9 | B | −20 | 2 + 5 | 242 | 75 |
| 10 | B | −20 | 3 + 5 | 223 | 75 |
| 11 | A | −17 | — | 26 | 71 |
| 12 | A | −17 | 5 | 25 | 62 |
| 13 | A | −17 | 1 + 5 | 23 | 60 |

Of the experiments 1–13 in example 4, experiments 3, 6, 8, 9, 10 and 13 are in accordance with the invention. In these experiments the dewaxing was carried out in the presence of alternating CO/$C_{10+}$ α-olefin polymers (exp. 3 and 8) or in the presence of a mixture of these polymers with $C_{8+}$ alkyl ester polymers (exp. 6, 9, 10 and 13). Experiments 1, 2, 4, 5, 7, 11 and 12 of example 4 fall outside the scope of the invention. They are included in the patent application for comparison. Examples 1–3 relate to the preparation of polymers which were used as additives in example 4. No dewaxing aid was used in experiments 1, 4, 7 and 11. In experiments 2, 5 and 12 the dewaxing was carried out in the presence of the $C_{8+}$ alkyl ester polymers, known for such a purpose, as dewaxing aid.

According to Experiment 2, the application of additive 4 leads to both an increase in the filtration rate and a reduction in the oil content of the filter cake. Experiment 3 demonstrates that this is also the case when an additive according to the invention is applied, but to a greater extent.

According to Experiment 5, the application of additive 5 leads to a reduction in the oil content of the filter cake, but this is accompanied by a reduction in the filtration rate. Experiment 6 demonstrates that the same reduction in the oil content of the filter cake results if an additive mixture according to the invention is applied, but this is now accompanied by an increase in the filtration rate.

According to Experiment 8, the application of an additive according to the invention leads to both an increase in the filtration rate and a decrease in the oil content of the filter cake. Experiment 9 demonstrates that this is also the case when an additive mixture according to the invention is applied, but to a greater extent. According to experiment 10, an additive mixture according to the invention leads to a reduction in the oil content of the filter cake. This is, however, accompanied by a slight decrease in the filtration rate.

According to Experiment 12, the application of additive 5 leads to a sharp reduction in the oil content of the filter cake. This is, however, accompanied by a slight decrease in the filtration rate. Experiment 13 demonstrates that a greater decrease in the oil content of the filter cake can be obtained by using an additive mixture according to the invention. The previously observed decrease in the filtration rate occurs to a greater degree in this case.

It was established by $^{13}$C-NMR analysis that the polymers prepared according to examples 1–3 were built up of linear chains wherein in these polymers monomer units of carbon monoxide and olefins are present in a substantially alternating arrangement. It was also established that in the polymers prepared from monomer mixtures containing more $C_{10+}$ α-olefins, the units from the various $C_{10+}$ α-olefins occurred in a random order relative to one another.

While this invention has been described in detail for the purpose of illustration, it is not to be construed as limited thereby but is intended to cover all changes and modifications within the spirit and scope thereof.

That which is claimed is:

1. A process for dewaxing a wax-containing hydrocarbon oil comprising the steps of precipitating and separating the wax from said hydrocarbon oil, wherein said precipitating step is conducted in the presence of a linear polymer of carbon monoxide with one or more olefins comprising α-olefins with at least 10 carbon atoms per molecule ($C_{10+}$ α-olefins), wherein in said polymer, monomer units of carbon monoxide and olefins are present in a substantially alternating arrangement.

2. A process as in claim 1 further comprising the addition of a polymer of one or more olefinically unsaturated compound comprising alkyl acrylates or alkyl methacrylates with at least 8 carbon atoms in the alkyl group ($C_{8+}$ alkyl esters) to the polymer of claim 1.

3. A process as in claim 2 wherein said dewaxing involves single-stage or multi-stage dilution methods.

4. A process as in claim 2 wherein said $C_{10+}$ α-olefins and the alkyl groups present in the $C_{8+}$ alkyl esters contain fewer than 30 carbon atoms.

5. A process as in claim 2 wherein said $C_{8+}$ alkyl ester polymers are selected from the group consisting of n-octadecyl acrylate/n-eicosyl acrylate/n-docosyl acrylate terpolymers and methyl acrylate/n-octadecyl acrylate/n-eicosyl acrylate/n-docosyl acrylate tetrapolymers.

6. A process as in claim 2 wherein said linear polymer of claim 1 is present in an amount of from about 1 to about 90 wt % of the total weight of the polymers.

7. A process as in claim 2 wherein said linear polymer of claim 1 is present in an amount of from about 10 to about 75 wt % of the total weight of the polymers.

8. A process as in claim 2 wherein said hydrocarbon oil is a waxy raffinate.

9. A process as in claim 1 wherein said hydrocarbon oil is a lubricating oil.

10. A process as in claim 1 wherein said hydrocarbon oil is a waxy raffinate.

11. A process as in claim 1 wherein said dewaxing is carried out in the presence of a dewaxing solvent.

12. A process as in claim 11 wherein said dewaxing solvent comprises a mixture of methyl ethyl ketone and toluene in which mixture the two components are present in approximately equal quantities.

13. A process as in claim 11 wherein said dewaxing solvent is present in an amount of from about 1–10 volumes per volume of wax-containing oil.

14. A process as in claim 13 wherein said dewaxing solvent is present in 1–4 volumes per volume of wax-containing oil.

15. A process as in claim 1 wherein said dewaxing involves single-stage or multi-stage dilution methods.

16. A process as in claim 1 wherein said dewaxing is conducted in the presence of a solvent/oil mixture having a temperature of from 45°-90° C. and at a dewaxing temperature of from −10° to −45° C.

17. A process as in claim 1 wherein said linear polymers have an average molecular weight, calculated as weight average ($\overline{M}_w$), of between $10^3$ and $10^6$.

18. A process as in claim 1 wherein said linear polymers are selected from the group consisting of carbon monoxide/n-octadecene-1 copolymers and polymers of carbon monoxide with a mixture of unbranched α-olefins with 12-18 or 20-24 carbon atoms per molecule.

19. A process as in claim 1 wherein said linear polymer is present in an amount of 1-10,000 mg polymer per kg hydrocarbon oil.

20. A process as in claim 19 wherein said linear polymer is present in an amount of 10-1000 mg polymer per kg hydrocarbon oil.

* * * * *